US008276787B1

(12) United States Patent
Gremillion et al.

(10) Patent No.: US 8,276,787 B1
(45) Date of Patent: Oct. 2, 2012

(54) COMBINATION BEVERAGE AND WATER DISPENSER

(76) Inventors: Paul J. Gremillion, Slidell, LA (US); Gary V. Triola, Pearl River, LA (US); Jane Triola, Pearl River, LA (US); Benjamin Triola, Pearl River, LA (US)

( * ) Notice: Subject to any disclaimer, the term of this patent is extended or adjusted under 35 U.S.C. 154(b) by 886 days.

(21) Appl. No.: 12/332,076

(22) Filed: Dec. 10, 2008

Related U.S. Application Data

(60) Provisional application No. 61/012,532, filed on Dec. 10, 2007.

(51) Int. Cl.
*B67D 7/80* (2010.01)

(52) U.S. Cl. ..... 222/146.1; 222/64; 222/129.1; 222/129.4; 222/145.5; 222/146.2; 222/146.6; 99/275; 99/323.3

(58) Field of Classification Search .... 222/129.1–129.4, 222/130–133, 135, 145.5, 52, 145.6, 54, 222/146.1, 64, 146.2, 65, 146.6, 66, 69, 144.5, 222/639–641; 99/275, 279, 290, 323.3, 280–282, 99/300

See application file for complete search history.

(56) References Cited

U.S. PATENT DOCUMENTS 4,470,999 A * 9/1984 Carpiac ..... 426/506
4,792,059 A * 12/1988 Kerner et al. ..... 222/67
5,014,611 A * 5/1991 Illy et al. ..... 99/280
5,042,689 A * 8/1991 Mrugala et al. ..... 222/66
5,246,141 A * 9/1993 Burrows ..... 222/146.1
5,285,718 A * 2/1994 Webster et al. ..... 99/290
5,584,229 A * 12/1996 Anson ..... 99/280
5,858,437 A * 1/1999 Anson ..... 426/431
5,975,365 A * 11/1999 Hsieh ..... 222/129.4
6,073,539 A 6/2000 Triola et al.
6,240,829 B1 * 6/2001 McGarrah ..... 99/275
6,460,735 B1 * 10/2002 Greenwald et al. ..... 222/146.1
6,636,151 B2 * 10/2003 Busick ..... 340/521
6,915,926 B2 * 7/2005 Naik ..... 222/146.6
7,028,603 B1 * 4/2006 Gremillion et al. ..... 99/290
7,861,646 B2 * 1/2011 Bockbrader ..... 99/323.3
7,866,508 B2 * 1/2011 Feldman et al. ..... 222/129.2

* cited by examiner

*Primary Examiner* — Frederick C. Nicolas
(74) *Attorney, Agent, or Firm* — Kenneth L Tolar

(57) ABSTRACT

A combination beverage and water dispenser includes a housing having a liquid-beverage-concentrate storage reservoir, a hot water storage tank and a cold water storage tank received therein. The cold water storage tank is in fluid communication with both a domestic water supply line and a dispensing cavity for receiving an inverted water bottle. Level sensors within the cold water storage tank communicate with a control valve on the domestic water supply line to control incoming domestic water supply. Alternatively, the domestic water supply may be disabled and a water bottle may be installed within the cavity to use bottled water in lieu of domestic water, if desired. The hot water tank, the cold water tank and the beverage concentrate reservoir are in selective communication with a mixing valve wherein hot or cold water and beverage concentrate are mixed to produce a desired hot or cold beverage. Accordingly, a user can instantly dispense a desired amount of beverage using either domestic water or bottled water.

17 Claims, 3 Drawing Sheets

COMBINATION BEVERAGE AND WATER DISPENSER

CROSS REFERENCE TO RELATED APPLICATIONS

This application is entitled to the benefit of provisional application No. 61/012,532 filed on Dec. 10, 2007, the specification of which is incorporated herein by reference.

BACKGROUND OF THE INVENTION

The present invention relates to a combination beverage and water dispenser that produces a beverage, such as coffee, by mixing liquid beverage concentrate with either bottled water or municipal water.

DESCRIPTION OF THE PRIOR ART

A conventional coffee brewing machine, such as an automatic drip coffee maker, is burdensome and time consuming to operate. Furthermore, the amount of coffee that can be brewed at any one time is limited. At least one dispenser for producing a desired amount of coffee using liquid coffee concentrate exists in the prior art, as depicted and described in U.S. Pat. No. 6,073,539 issued to Triola, et al. Though the device overcomes many of the disadvantages of conventional coffee brewing equipment, it is designed to exclusively use bottled water. However, in certain situations, bottled water may not be available or desired. Accordingly, there is currently a need for a combination water and coffee dispenser that is capable of mixing beverage concentrate with either bottled or municipal water. The present invention provides a combination beverage and water dispenser that can interchangeably produce a desired beverage using liquid beverage concentrate and either bottled water or municipal water.

SUMMARY OF THE INVENTION

The present invention relates to a combination beverage and water dispenser including a housing having a liquid beverage concentrate storage reservoir, a hot water storage tank and a cold water storage tank received therein. The cold water storage tank is in fluid communication with both a domestic water supply line and a dispensing cavity for receiving an inverted water bottle. Level sensors within the cold water storage tank communicate with a control valve on the domestic water supply line to control incoming domestic water supply. Alternatively, the domestic water supply may be disabled and a water bottle may be installed within the cavity to use bottled water in lieu of domestic water, if desired. The hot water tank, the cold water tank and the beverage concentrate reservoir are in selective communication with a mixing valve wherein hot or cold water and beverage concentrate are mixed to produce a desired hot or cold beverage. Accordingly, a user can instantly dispense a desired amount of beverage using either domestic water or bottled water.

It is therefore an object of the present invention to provide a combination water and beverage dispenser that allows a user to instantly produce a desired amount of beverage.

It is another object of the present invention to provide a beverage and water dispenser that can instantly deliver a desired amount of beverage using either municipal or bottled water.

It is yet another object of the present invention to provide a combination water and beverage dispenser that allows a user to quickly and easily produce a desired amount of beverage.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
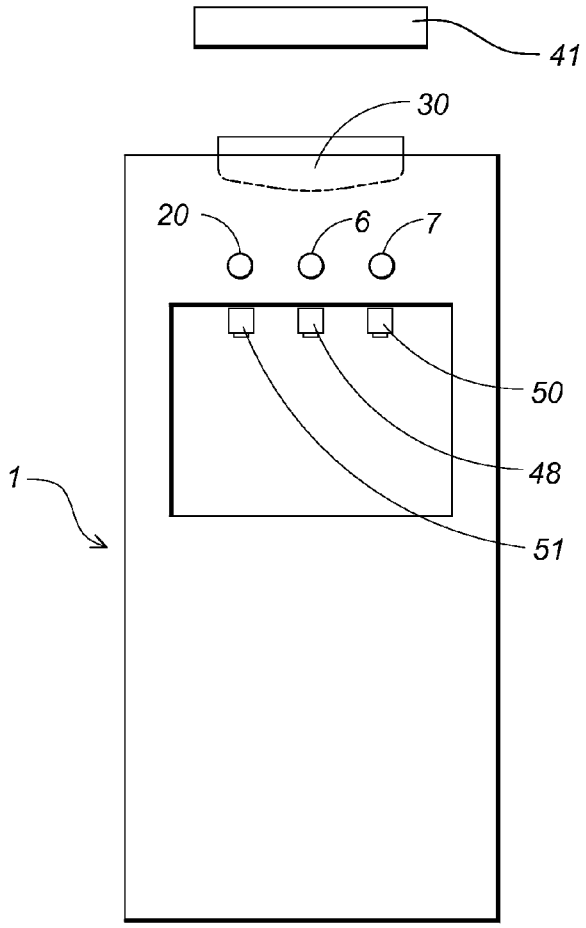
FIG. 1 is a front view of the housing.
Figure 2:
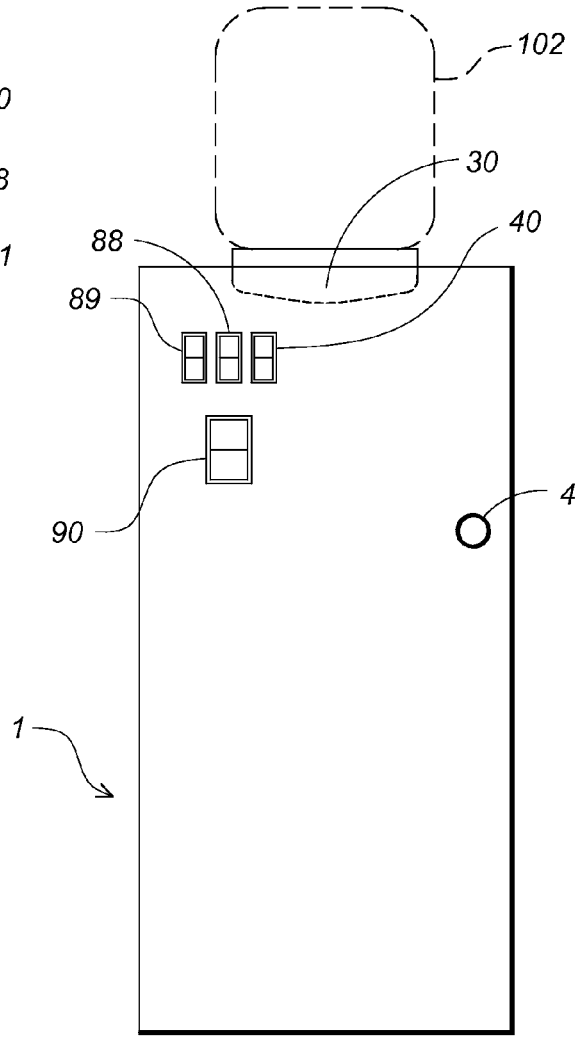
FIG. 2 is a rear view of the housing.
Figure 3:
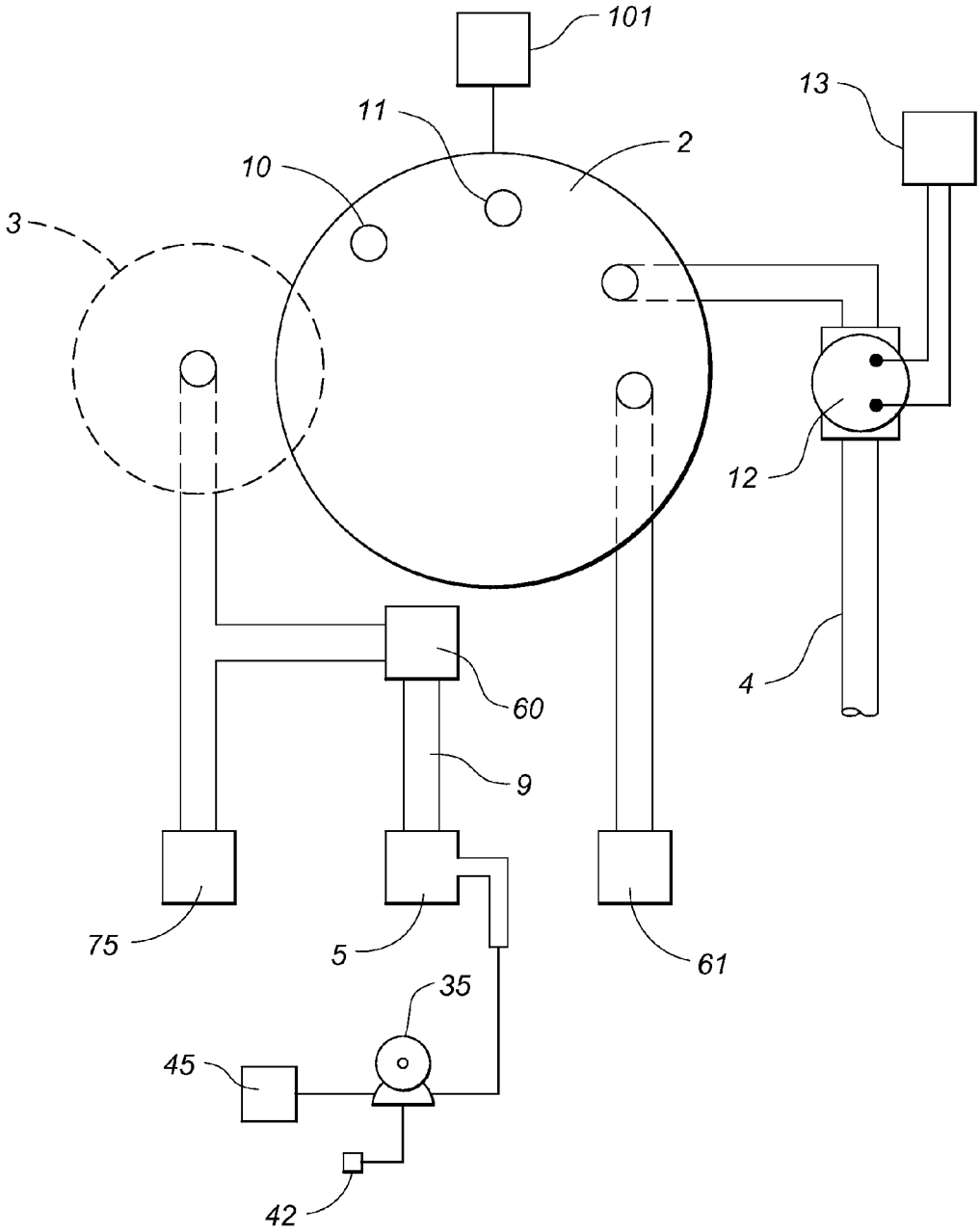
FIG. 3 is a top view of the internal components.

The present invention relates to a combination water and beverage dispenser specifically designed to instantly produce a beverage using liquid beverage concentrate. The device includes a hollow housing 1 having an interior chamber with a liquid beverage concentrate pump 35, a cold water storage tank 2 and a hot water storage tank 3 received therein. The cold water storage tank has an associated compressor 101 for chilling water received therein similar to those found on conventional bottled water dispensers. Similarly, the hot water storage tank includes a heater for heating water therein to a predetermined temperature. A water supply line 4 coupled with a domestic water source extends into the housing interior chamber and is connected to the cold water storage tank for supplying fresh water thereto. The cold water storage tank supplies water to the hot water storage tank.

The beverage pump 35 delivers liquid beverage concentrate from a liquid beverage storage reservoir 45 or container to a mixing valve 5. A hot water supply line 9 extends from the hot water storage tank to the mixing valve 5 wherein the hot water and liquid beverage concentrate are mixed to produce a hot beverage. A button 6 positioned on an outer wall of the housing activates the beverage pump and a valve 60 to deliver beverage concentrate and hot water to the mixing valve, and subsequently to a dispensing spout 48 on the housing exterior. A second button 7 activates a cold water supply valve 61 to dispense chilled water directly from the chilled water tank to a cold water dispensing spout 50; a third button 20 opens a hot water supply valve 75 to dispense hot water directly from the hot water tank to a hot water dispensing spout 51. A potentiometer 42 adjusts the liquid beverage pump speed to vary the concentration of beverage being produced within the mixing valve 5.

Figure 4:
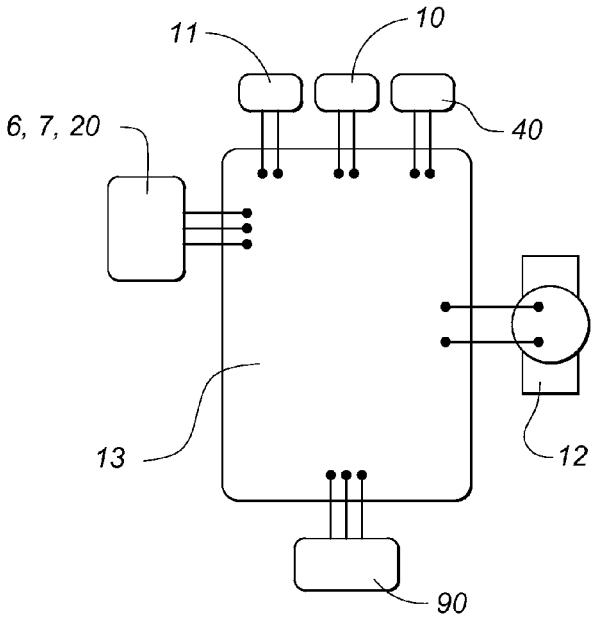
FIG. 4 is a schematic of the timer circuit and associated components.
Figure 6:
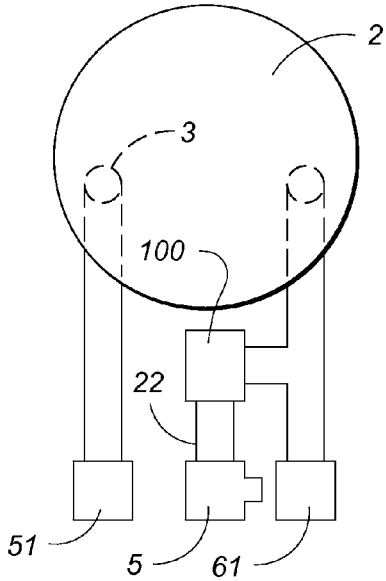
FIG. 6 depicts a slightly different embodiment of the present invention.

Domestic water supply is controlled with a lower sensor 10 and an upper sensor 11, i.e., float valves, positioned within the cold water storage tank. The sensors are in communication with a control valve 12 mounted on the domestic water supply line. If the lower sensor detects an insufficient water level within the cold water tank, the control valve is opened to provide additional water. Once the level within the tank reaches the lower sensor, it closes the control valve to disable water flow. The upper sensor provides an emergency shutdown if the lower sensor malfunctions. Furthermore, the domestic water inlet includes a vent tube 80 having an aperture 81 thereon for preventing siphoning of the cold water storage tank when bottled water is being used. In addition to the level sensors, the control valve is also actuated by a timer circuit 13, as depicted in FIG. 4, that automatically disables water flow after a predetermined duration in the event that the upper sensor malfunctions, if there is a water leak that prevents the water tank from filling or if there is an internal leak.

The device is also equipped to operate using bottled water in lieu of domestic water, if desired. On the top end of the housing is a cavity 30 that receives the lower end of an inverted water bottle 102, which is similar to that found on a conventional bottled water dispenser. The cavity includes a conventional dispensing mechanism for establishing fluid communication between the bottle and the cold water storage tank when the bottle is properly erected. When bottled water is being used, the control valve, the timer circuit and sensors are disabled by a manual switch 40. When domestic water is being used, the cavity is concealed by superimposing a plate 41 thereon. Likewise, the compressor and heater are disabled with switches 88, 89 respectively while a main power switch 90 activates all of the aforementioned electrical components.

Figure 5:
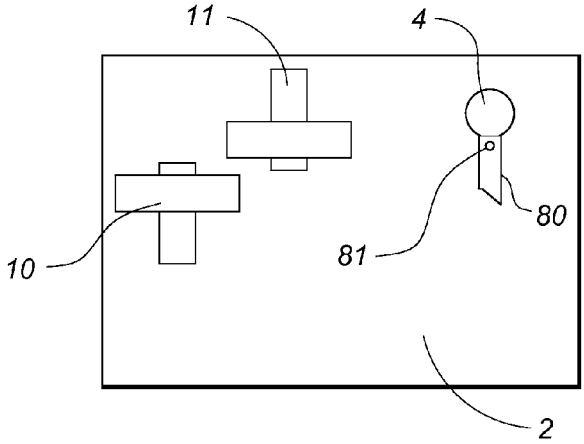
FIG. 5 is a front cutaway view of the cold water storage tank.

An alternative embodiment is depicted in FIG. 5. A cold water supply line 22 extends from the cold water tank to the mixing valve allowing a user to instantly produce a chilled beverage using a liquid beverage concentrate, if desired. Accordingly, depressing the beverage dispense button 6, or another beverage dispense button, activates the pump and a valve 100 to deliver both beverage concentrate and chilled water to the mixing valve 5. As such, the dispenser according to the present invention could either include the means for producing a hot beverage, a cold beverage or both.

The present invention is not to be limited to the exact details of construction and enumeration of parts described above. For example, though the device is primarily designed to produce coffee using liquid coffee concentrate, it can also be used to produce any desired beverage from beverage concentrate whether heated, chilled or room temperature. Furthermore, any type of pump or conventional fluid delivery means could be used to deliver beverage concentrate to the mixing valve without departing from the scope of the claimed invention. Additionally, the size, shape and materials of construction of the various components can be varied to suit a particular application.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination beverage and water dispenser comprising:

a hollow housing having a beverage concentrate storage reservoir, an outer surface and an interior chamber;

a heater means for heating a desired quantity of water;

a chiller means for chilling a desired quantity of water;

means for delivering a desired amount of water from either of a water container and a domestic water supply source to said chiller means and said heater means;

a mixing chamber in communication with said heater means and said chiller means;

means for delivering a desired amount of water from either of said chiller means and said heater means to said mixing chamber;

means for delivering a desired amount of beverage concentrate from said reservoir to said mixing chamber to produce a desired beverage therein having a desired temperature;

a cavity on said housing that receives said water container, said cavity in fluid communication with said chiller means.

2. The combination according to claim 1 wherein said heater means comprises:

a heated storage tank.

3. The combination according to claim 2 wherein said chiller means comprises:

a cold water storage tank having a compressor associated therewith for chilling water received within said cold water storage tank.

4. The combination according to claim 3 wherein said means for delivering a desired amount of water from either of a water container and a domestic water supply source comprises:

a supply line extending from a domestic water source to said cold water storage tank;

an automated control means for automatically delivering water from said supply line to said cold water storage tank upon a level within said cold water storage tank decreasing below a predetermined threshold;

said container in fluid communication with said cold water storage tank;

means for delivering water from said cold water storage tank to said heated tank.

5. The combination according to claim 4 wherein said automated control means comprises:

a lower sensor positioned within said cold water storage tank;

a control valve mounted on said supply line, said control valve in communication with said lower sensor whereby if the lower sensor detects an insufficient water level within the cold water storage tank, the control valve is opened to provide additional water from said domestic water source, and when said water level within the cold water storage tank reaches the lower sensor, said lower sensor closes said control valve to disable water flow.

6. The combination according to claim 5 further comprising a timer circuit in communication with said control valve that automatically closes said control valve after a predetermined duration.

7. The combination according to claim 1 wherein said means for delivering a desired amount of beverage concentrate from said reservoir to said mixing chamber comprises a variable speed pump.

8. The combination according to claim 7 wherein said pump is activated with a button positioned on the outer surface of said housing.

9. The combination according to claim 7 wherein said pump includes a potentiometer that adjusts the pump speed to vary a concentration of beverage being produced in said mixing chamber.

10. The combination according to claim 1 further comprising a plate removably superimposed on said cavity, said plate concealing said cavity when said domestic water supply is in use.

11. The combination according to claim 6 further comprising means for disabling water flow from said domestic source when said container is being used.

12. The combination according to claim 11 wherein said means for disabling water flow from said domestic source when said container is being used comprises a switch that disables said control valve, said timer circuit and said sensors.

13. The combination according to claim 2 further comprising means for dispensing hot water directly from said heated storage tank.

14. The combination according to claim 3 further comprising means for dispensing cold water directly from said cold water storage tank.

15. The combination according to claim 5 further comprising an upper sensor positioned within said cold water storage tank at an elevation greater than said lower sensor, said upper sensor in communication with said control valve, said upper sensor disabling said control valve upon detecting liquid.

16. The combination according to claim 4 wherein said supply line includes a vent tube at a distal end, said vent tube extending into said cold water storage tank, said vent tube having an aperture thereon for preventing said cold water storage tank from draining when said water container is in use.

17. A combination beverage and water dispenser comprising:

a hollow housing having a beverage concentrate storage reservoir, an outer surface and an interior chamber;

a heated storage tank;

a cold water storage tank having a compressor associated therewith for chilling water received within said cold water storage tank;

means for delivering a desired amount of water from either of a water container and a domestic water supply source to said heated storage tank and said cold water storage tank;

a mixing chamber in communication with said heated storage tank and said cold water storage tank;

means for delivering a desired amount of water from either of said heated storage tank and said cold water storage tank to said mixing chamber, wherein said means for delivering a desired amount of water from either of a water container and a domestic water supply source comprises a supply line extending from a domestic water source to said cold water storage tank wherein said supply line includes a vent tube at a distal end, said vent tube extending into said cold water storage tank, said vent tube having an aperture thereon for preventing said cold water storage tank from draining when said water container is in use, an automated control means for automatically delivering water from said supply line to said cold water storage tank upon a level within said cold water storage tank decreasing below a predetermined threshold, said container in fluid communication with said cold water storage tank; means for delivering water from said cold water storage tank to said heated tank and a means for delivering a desired amount of beverage concentrate from said reservoir to said mixing chamber to produce a desired beverage therein having a desired temperature.

* * * * *